US005417302A

United States Patent [19]

McElfresh

[11] Patent Number: 5,417,302

[45] Date of Patent: May 23, 1995

[54] STEPLADDER STABILIZER

[76] Inventor: Ramon E. McElfresh, P.O. Box 10095, Prescott, Ariz. 86304

[21] Appl. No.: 237,847

[22] Filed: May 4, 1994

[51] Int. Cl.[6] ..... E06C 7/46

[52] U.S. Cl. ..... 182/108; 182/230

[58] Field of Search ..... 182/107–111, 182/230

[56] References Cited

U.S. PATENT DOCUMENTS

| | | | |
|---|---|---|---|
| 1,918,293 | 7/1933 | Seiler | 182/107 X |
| 4,394,887 | 7/1983 | Spinks | 182/107 X |
| 4,457,397 | 7/1984 | Scala | 182/107 |
| 4,603,758 | 8/1986 | Pettit | 182/111 X |
| 5,141,076 | 8/1992 | Joyce et al. | 182/108 |

FOREIGN PATENT DOCUMENTS

| | | | |
|---|---|---|---|
| 486643 | 9/1952 | Canada | 182/120 |
| 2142076 | 1/1985 | United Kingdom | 182/111 |
| 2216168 | 10/1989 | United Kingdom | 182/108 |
| 011427 | 7/1992 | WIPO | 182/108 |

*Primary Examiner*—Alvin C. Chin-Shue

[57] ABSTRACT

Disclosed is a new stepladder stabilizer for improving stability of a conventional folding stepladder during use on soft areas into which the stepladder might tend to sink and additionally for improving the lateral stability of the stepladder. The stepladder stabilizer comprises an elongated rigid pad engagable with the stepladder supporting surface, normally the ground or a floor. The pad comprises left and right sections telescoped together to form a rectangular pad with an planar engagement surface on the bottom thereof. An integrally formed socket projects upwardly from each pad section wherein the stepladder leg tips may be removably inserted to hold the pad in alignment directly thereunder. Weight applied to the leg tips is spread over the area of the pad engagement surface whereby increasing the effective surface area of the leg tips. Spacing between the sockets may be adjusted to match the spacing of the legs by sliding the left pad section longitudinally relative the right pad section.

1 Claim, 3 Drawing Sheets

STEPLADDER STABILIZER

BACKGROUND OF THE INVENTION

1. Field of the Invention

The present invention relates to ladder stabilizing devices and more particularly pertains to a stepladder stabilizer which may be adapted for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder.

2. Description of the Prior Art

The use of ladder stabilizing devices is known in the prior art. More specifically, ladder stabilizing devices heretofore devised and utilized for the purpose of preventing tipping of a ladder while in use are known to consist basically of familiar, expected and obvious structural configurations, notwithstanding the myriad of designs encompassed by the crowded prior art which have been developed for the fulfillment of countless objectives and requirements.

The present invention is directed to improving devices for preventing tipping of a ladder while in use in a manner which is safe, secure, economical and aesthetically pleasing.

U.S. Pat. No. 5,141,076 to Joyce et al. describes a stepladder foot pad consisting of a semi-rigid pad that when attached to the bottom of any or all of the legs of any standard wooden folding stepladder will then increase the stepladder leg footprint area resulting in more stability of said stepladder. The foot pad disclosed in the above invention increases the leg footprint area by only a limited amount which could result in unsatisfactory performance when used on very soft surfaces. Furthermore, no way is shown to improve the lateral stability of the stepladder.

The prior art also discloses a stepladder stabilizer assembly as shown in U.S. Pat. No. 4,433,754 to Beach, a laterally stabilized stepladder of U.S. Pat. No. 3,786,900 to Olsen, and a stepladder stabilizer in U.S. Pat. No. 3,901,354 to Grebausky, all consisting of similar devices consisting of one or more extensible support legs pivotally extending from the top platform of the stepladder laterally outwardly and downwardly to the ladder supporting surface. All of these devices use a pole-like outrigger which may create a tripping obstruction safety hazard, particularly in crowded work areas. None of the patents disclose a way to prevent the ladder from sinking into a soft supporting surface.

The prior art also shows a step ladder foot-platform of U.S. Pat. No. 5,060,755 to Bourdanges et al. While this device fulfills its particular objectives and requirements, the aforementioned patent does not disclose a stepladder stabilizer for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder.

In this respect, the stepladder stabilizer according to the present invention substantially departs from the conventional concepts and designs of the prior art, and in so doing provides an apparatus primarily developed for the purpose of improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder.

Therefore, it can be appreciated that there exists a continuing need for a new stepladder stabilizer which can be used for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder. In this regard, the present invention substantially fulfills this need.

As illustrated by the background art, efforts are continuously being made in an attempt to develop devices for preventing tipping of a ladder while in use. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of ladder stabilizing devices now present in the prior art, the present invention provides a new ladder stabilizing devices construction wherein the same can be utilized for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder. As such, the general purpose of the present invention, which will be described subsequently in greater detail, is to provide a new stepladder stabilizer apparatus and method which has all the advantages of the prior art ladder stabilizing devices and none of the disadvantages.

The invention is defined by the appended claims with the specific embodiment shown in the attached drawings. For the purpose of summarizing the invention, the invention may be incorporated into a new stepladder stabilizer for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder.

The stepladder stabilizer comprises an elongated pad formed of acrylonitrile-butadiene-styrene (ABS) plastic engagable with a stepladder supporting surface, normally the ground or a floor. The pad comprises left and right sections telescoped together to form a generally rectangular pad with an essentially flat top and opposing ends. An essentially planar engagement surface is formed on the bottom of the pad. The left pad section is slippingly disposed within the right pad section such that the opposed ends of the combined pad sections may be moved toward and away from each other.

Attachment means is included for attaching the stepladder rear legs to the pad such that weight applied to the leg tips is spread over the area of the pad engagement surface whereby increasing the effective surface area of the leg tips. The attachment means comprises an integrally formed stepladder leg receiving socket projecting upwardly from the top of each pad section near the opposed end thereof wherein the leg tips may be removably inserted to hold the pad in alignment directly under the leg tips. The legs are secured within the sockets by the force of the weight of the stepladder. The spacing between the sockets may be adjusted to correspond to the spacing of the stepladder legs by sliding the left pad section longitudinally relative the right pad section.

The stepladder stabilizer has a pair of longitudinal ridges formed along the top to increase the strength of the device to resist bending and breaking when used on an uneven supporting surface. Also provided is a plurality of recessed areas formed on the engagement surface to improve frictional engagement of the stabilizer with the supporting surface to reduce the possibility of lateral slippage when the stabilizer is used on a hard supporting surface.

The opposed end of each pad section also has a closure to prevent moisture, dirt, and other foreign material from entering the hollow space of the section. Each closure comprises a plug portion frictionally engaged within the open end of the hollow pad section and an enlarged cap portion having a cross sectional shape essentially the same as the cross sectional shape of the pad section exterior.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new stepladder stabilizer for improving stability of a conventional folding stepladder during use on soft areas into which the stepladder might tend to sink.

It is another object of the present invention to provide a new stepladder stabilizer which may be easily and efficiently manufactured and marketed.

It is a further object of the present invention to provide a new stepladder stabilizer which is of a durable and reliable construction.

An even further object of the present invention is to provide a new stepladder stabilizer which is susceptible of a low cost of manufacture with regard to both materials and labor, and which accordingly is then susceptible of low prices of sale to the consuming public, thereby making such stepladder stabilizers economically available to the buying public.

Still yet another object of the present invention is to provide a new stepladder stabilizer which provides in the apparatuses and methods of the prior art some of the advantages thereof, while simultaneously overcoming some of the disadvantages normally associated therewith.

Still yet another object of the present invention is to provide a new stepladder stabilizer for improving the lateral stability of a stepladder to help compensate for a user shifting the center of gravity of the combined stepladder and load beyond the normal safe limits of the ladder.

Yet another object of the present invention is to provide a new stepladder stabilizer that is adjustable to enable it to be used with a wide variety of different stepladders without modification to the stabilizer or the ladder.

Even still another object of the present invention is to provide a new stepladder stabilizer that is small and lightweight so as to be easily stored and transported.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
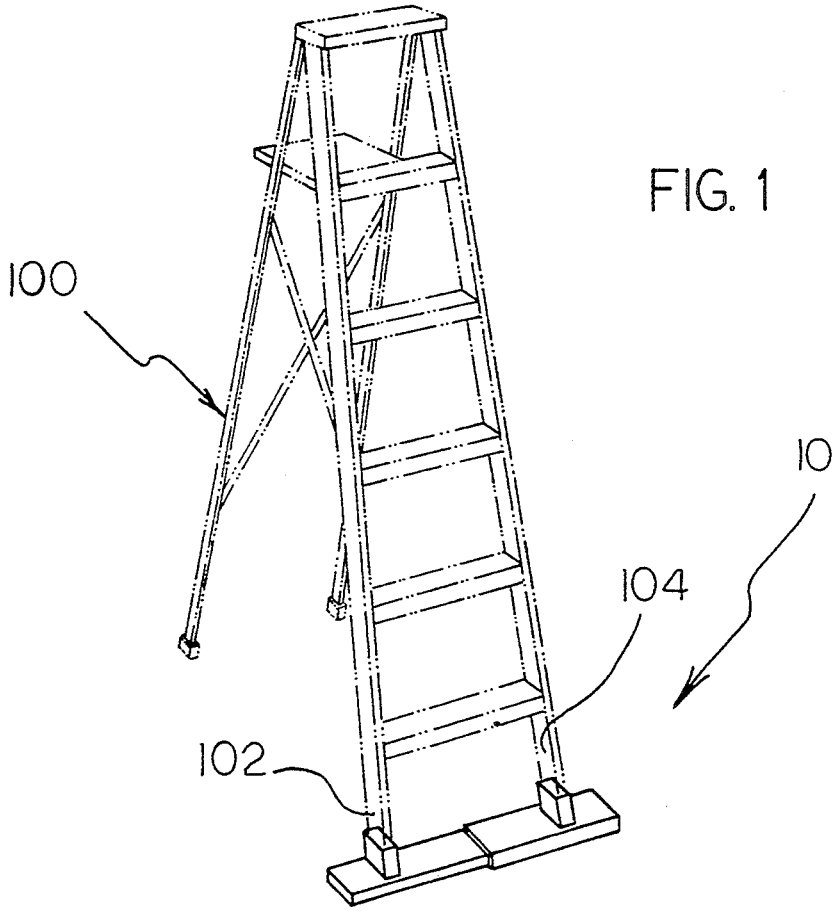
FIG. 1 is a top perspective view of the new stepladder stabilizer showing its manner of use.
Figure 2:
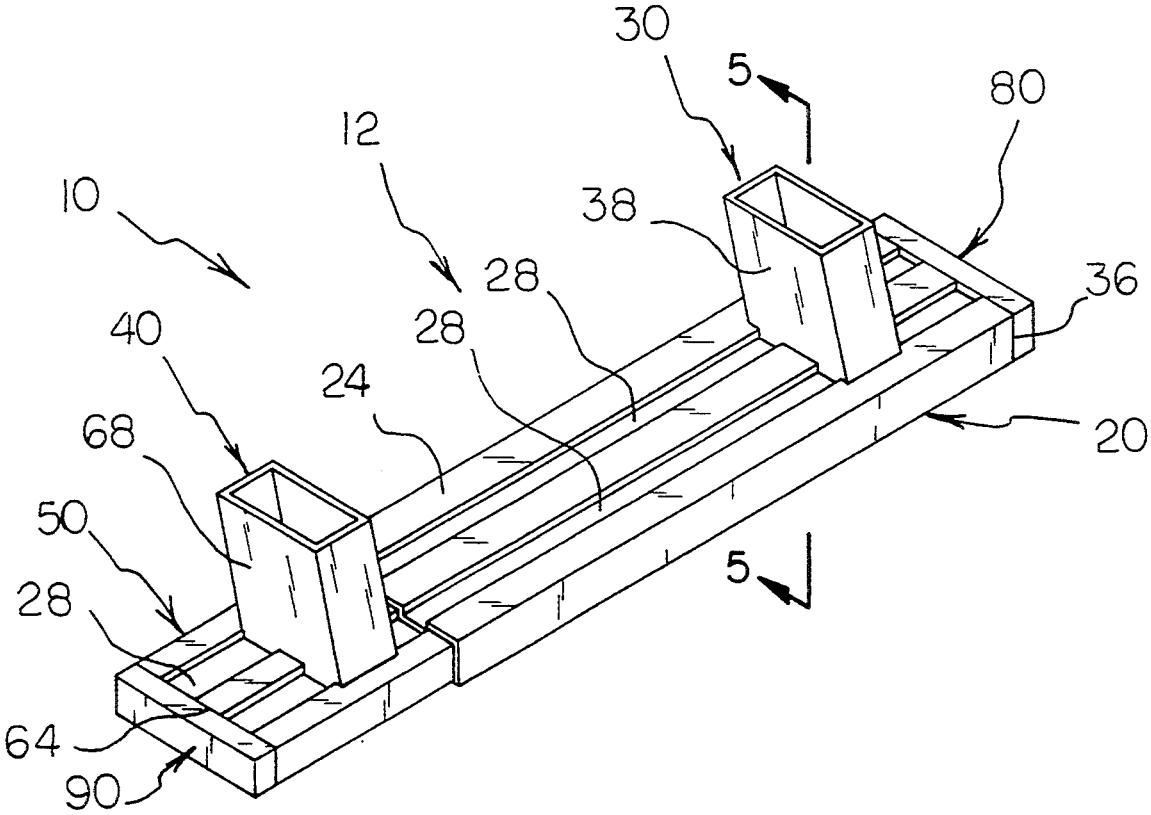
FIG. 2 is a top perspective view of the preferred embodiment of the present invention.
Figure 3:
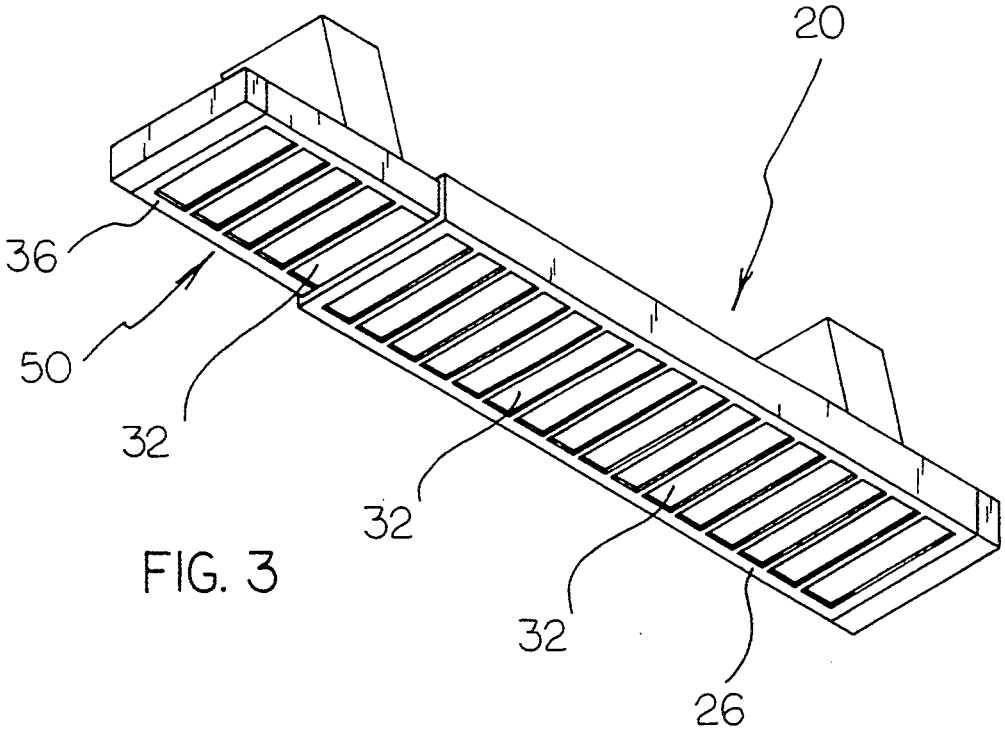
FIG. 3 is a bottom perspective view of the invention of FIG. 2 showing the planar engagement surface with formed recesses to reduce lateral slipping of the stabilizer across the supporting surface.
Figure 4:
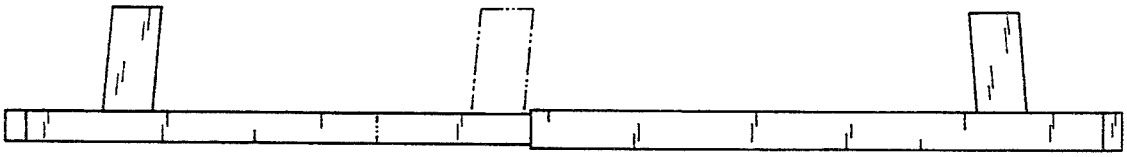
FIG. 4 is a front elevational view of the invention of FIG. 2 illustrating its manner of adjustment for stepladders having different leg spacings.
Figure 5:
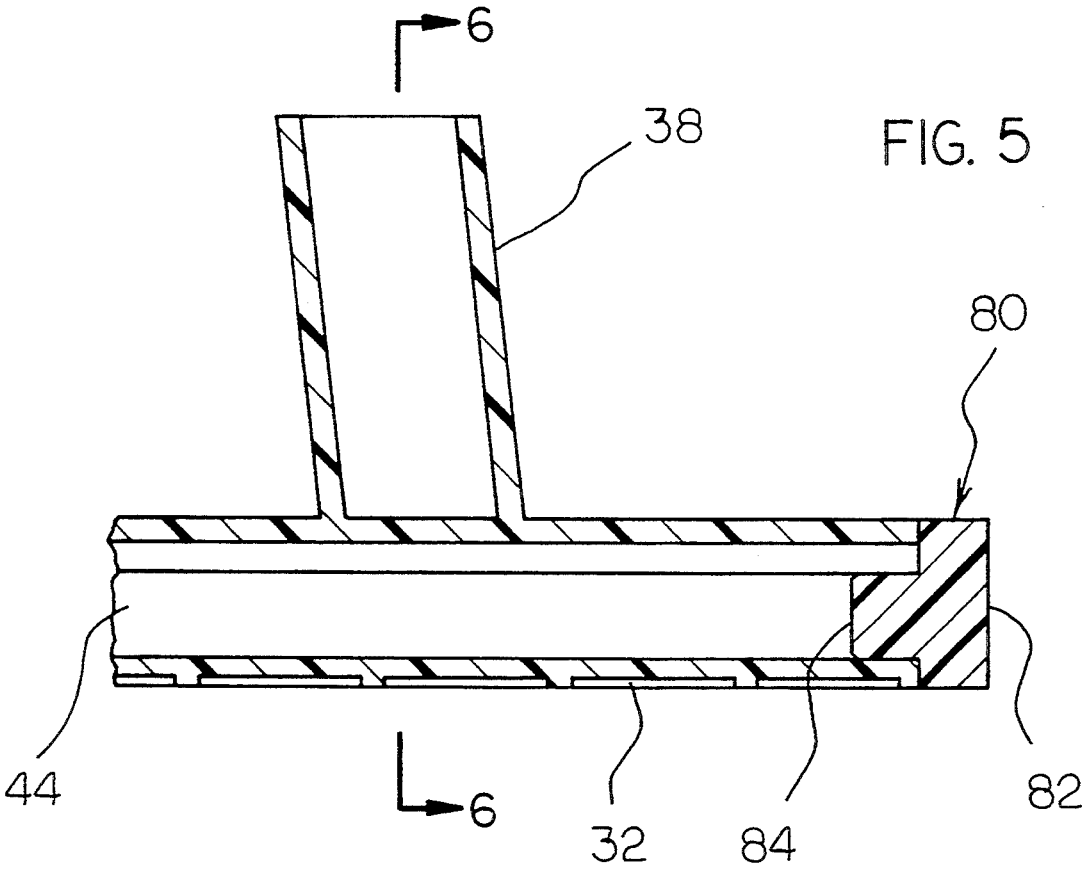
FIG. 5 is a sectional view of the invention of FIG. 2 taken along the line 5—5.
Figure 6:
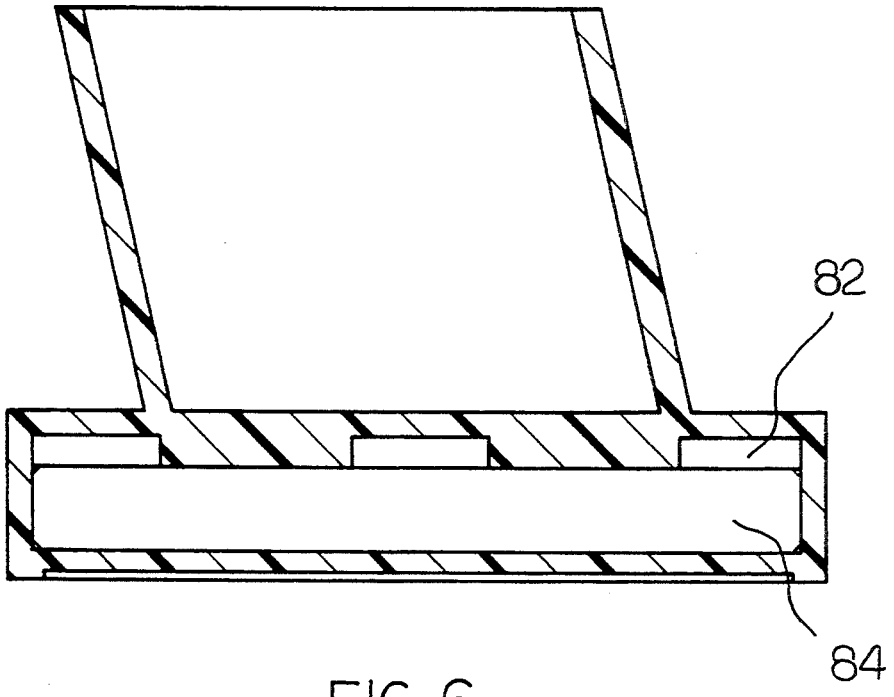
FIG. 6 is a sectional view of the invention of FIG. 5 taken along the line 6—6.

With reference now to the drawings, and in particular to FIG. 1 thereof, a new stepladder stabilizer embodying the principles and concepts of the present invention and generally designated by the reference numeral 10 will be described.

From an overview standpoint, the stepladder stabilizer is adapted for use for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder. See FIG. 1.

With reference now to FIGS. 1–6 and more specifically, it will be noted that a new stepladder stabilizer 10 is shown. The stepladder stabilizer 10 comprises an elongated pad 12 formed of acrylonitrile-butadiene-styrene (ABS) plastic engagable with a stepladder supporting surface, normally the ground or a floor. The pad 12 comprises left and right sections 50 and 20 telescoped together to form a generally rectangular pad with an essentially flat top 24 and opposing ends 64 and 36. An essentially planar engagement surface 26 is formed on the bottom of the pad 12. The left pad section 50 is slippingly disposed within the right pad section 20 such that the opposed ends 64 and 36 of the combined pad sections may be moved toward and away from each other.

Attachment means 40 and 30 is included for attaching the stepladder rear legs 102 and 104 to the pad 12 such that weight applied to the leg tips is spread over the area of the pad engagement surface 26 whereby increasing the effective surface area of the leg tips. The attachment means comprises an integrally formed stepladder leg receiving socket 68 and 38 projecting upwardly from the top of each pad section 50 and 20 near the opposed end thereof wherein the leg tips may be removably inserted to hold the pad 12 in alignment directly under the leg tips. The legs 102 and 104 are secured within the sockets 68 and 38 by the force of the weight of the stepladder 100. The spacing between the sockets 68 and 38 may be adjusted to correspond to the spacing of the stepladder legs 102 and 104 by sliding the left pad section 50 longitudinally relative the right pad section 20.

The pad 12 has a pair of longitudinal ridges 28 formed along the top to increase the strength of the device to resist bending and breaking when used on an uneven supporting surface. Also provided are a plurality of recessed areas 32 formed on the engagement surface 26 to improve frictional engagement of the stabilizer 10 with the supporting surface to reduce the possibility of lateral slippage when the stabilizer is used on a hard supporting surface.

The opposed end 64 and 36 of each pad section also has a closure 90 and 80 to prevent moisture, dirt, and other foreign material from entering the hollow space 44 of the section. Each closure comprises a plug portion 84 frictionally engaged within the open end of the hollow pad section and an enlarged cap portion 82 having a sectional shape essentially the same as the sectional shape of the pad section exterior.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes Will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new stepladder stabilizer for improving stability of a conventional folding stepladder during use on soft areas into which the stepladder might tend to sink and additionally for improving the lateral stability of the stepladder to help compensate for a user shifting the center of gravity of the combined stepladder and load beyond the normal safe limits of the ladder, the stepladder stabilizer comprising:

an elongated pad engagable with a stepladder supporting surface, the pad being generally rectangular with an essentially flat top and opposing ends, the pad having an essentially planar engagement surface formed on the bottom thereof, the flat top further including a plurality of essentially horizontal longitudinal ridges formed thereon whereby increasing the strength of the stabilizer to resist bending and breaking when used on an uneven supporting surface, the engagement surface being formed on the bottom thereof and further including a plurality of essentially horizontal recessed areas formed thereon whereby improving frictional engagement of the stabilizer with the supporting surface to reduce the possibility of lateral slippage when the stabilizer is used on a hard supporting surface;

attachment means for attaching the stepladder rear legs to the pad such that weight applied to the leg tips is spread over the area of the pad engagement surface whereby increasing the effective surface area of the leg tips, the attachment means comprising a stepladder leg receiving socket projecting upwardly from the top of the pad near each end thereof wherein the leg tips may be removably inserted to hold the pad in alignment directly under the leg tips, the legs being secured within the sockets by the force of the weight of the stepladder, the pad and attachment means being formed of acrylonitrile-butadiene-styrene (ABS) plastic; and adjustment means whereby the pad may be adjusted to fit the leg spacing of a variety of different stepladders, the adjustment means comprising left and right hollow pad sections, the left pad section being telescopingly slippingly disposed for relative movement essentially horizontally within the right pad section such that the opposed ends of the combined pad sections may be moved toward and away from each other, the opposed ends also being closed for preventing moisture, dirt, and other foreign material from entering the hollow space of the sections, and a stepladder leg receiving socket projecting upwardly from the top of each pad section near the opposed end thereof whereby the spacing between the sockets may be adjusted to correspond to the spacing of the stepladder legs by sliding the left pad section longitudinally relative the right pad section.

* * * * *